US005580617A

United States Patent [19]

Biederer et al.

[11] Patent Number: 5,580,617

[45] Date of Patent: Dec. 3, 1996

[54] METHOD FOR MANUFACTURING TIN-COATED STRIPS OR SHEETS FROM COPPER OR A COPPER ALLOY

[75] Inventors: Hans H. Biederer; Stefan Hoveling, both of Osnabrück, Germany

[73] Assignee: KM-Europa Metal Aktiengesellschaft, Osnabrück, Germany

[21] Appl. No.: 376,516

[22] Filed: Jan. 23, 1995

[30] Foreign Application Priority Data

Feb. 15, 1994 [DE] Germany ..... 44 04 669.5

[51] Int. Cl.[6] ..... B05D 3/06

[52] U.S. Cl. ..... 427/555; 427/566; 427/576; 427/433; 427/436; 205/252; 205/300

[58] Field of Search ..... 427/555, 566, 427/596, 433, 436; 205/252, 300

[56] References Cited

U.S. PATENT DOCUMENTS

| | | | |
|---|---|---|---|
| 4,413,768 | 11/1983 | Niwiera et al. | 228/173 A |
| 4,515,671 | 5/1985 | Polan et al. | 204/228 |
| 4,750,976 | 6/1988 | Hupe et al. | 204/15 |
| 5,282,890 | 2/1994 | Protzer et al. | 148/276 |
| 5,354,624 | 10/1994 | Carey, II | 428/647 |
| 5,376,190 | 12/1994 | Hoveling | 148/269 |

*Primary Examiner*—Benjamin Utech
*Attorney, Agent, or Firm*—Kenyon & Kenyon

[57] ABSTRACT

A method for manufacturing a tin-coated surface of rolled copper strips or copper-alloy strips, wherein a strip surface is mechanically treated using a textured working roll to adjust a texture on said strip surface of an average peak-to-valley height within the range of 3 to 12 μm and the textured strip surface is then continuously coated with tin or a tin-base alloy.

8 Claims, No Drawings

METHOD FOR MANUFACTURING TIN-COATED STRIPS OR SHEETS FROM COPPER OR A COPPER ALLOY

FIELD OF THE INVENTION

The invention relates to a method for manufacturing tin-coated strips or sheets from copper or a copper alloy. More particularly, the invention relates to the use of tin-coated, strip-shaped semifinished products in the construction field, especially for roofing or facade facing.

BACKGROUND OF THE INVENTION

Under normal atmospheric conditions, an adherent and resistant durable surface layer builds up on the top surface of ungalvanized copper and develops further, after the passage of time, into a uniform brown color, because of the reaction of the copper with moisture and/or atmospheric oxygen.

However, for the different applications, particularly in the construction field, the request is often made for decorative, dull-silver-colored surfaces, which are resistant under conditions such as exposure to weather or a treatment with chemical solutions. It is furthermore intended that the appearance of the top surface will not change substantially due to handling during installation nor due to exposure to weather.

DESCRIPTION OF THE INVENTION

The object of the invention is to specify a method which will make it possible to improve the optical appearance of the top surfaces of strip-shaped semifinished products of copper or of a copper alloy. In addition, the relatively substantial sensitivity of the surfaces to adverse mechanical and chemical influences shall be reduced.

This objective is solved according to the invention in that the strip-shaped, semifinished copper product is first rolled by means of a textured working roll to adjust the surface quality to an average peak-to-valley height within the range of 3 to 12 μm and then continuously coated with tin or a tin-base alloy, the ratio of average peak-to-valley height to thickness of the tin layer being greater than 1.2, preferably greater than 2.

Advantageous further features of the method according to the invention are as follows. Preferably at least one surface of the strip is mechanically surface treated with a roll which has been textured by means such as a laser or electron beam. Preferably, the tin or tin-based alloy is coated on the strip either galvanically or by using molten techniques. In both cases, the thickness of the tin layer is between 1 and 8 μm. One preferred field of application for the surface-finished, strip-shaped semifinished product is as a material for roofing or facade facing.

In using the measures of the method according to the present invention, one succeeds in a surprisingly simple manner to produce a surface-finished, strip-shaped semifinished product from copper material, which, at least on the structured strip surface, has a dull, silver-colored appearance.

The invention can be illustrated further in the following on the basis of a few exemplary embodiments.

The surface of a cold-rolled and, in some instances, degreased strip of SF-Cu having a thickness of 0.72 mm and a width of 670 mm was roughened on one side in a twin rolling stand using a textured working roll. Following the roll treatment, the essentially regularly textured surface of the copper strip had an average peak-to-valley height of about 5 μm. The copper strip was then coated with a galvanically applied pure tin layer of 1.2 μm thickness.

The quality of the relatively thin, pure-tin layer applied to the textured strip surface was quite uniformly dull-bright, insensitive in handling, and optically also proved to be sufficiently opaque. On the other hand, the likewise coated, non-textured rear side of the strip exhibited a high light reflectivity. Conspicuous finger smudges and resultant irregular discolorations caused during handling remained on the surface. However, these disadvantages do not disturb the rear side of the strip.

A metallographic examination of the microstructure of the tin layer showed a uniform distribution of the tin particles on the textured base material.

As a variation of the exemplary embodiment, four additional roll material samples were roughened on one side on working rolls that had been textured in different ways. Working rolls, whose surfaces had been textured by laser or by means of electron beam treatment, were available, as well as those whose roughness structure had been produced by the spark-erosion method. The process of coating with pure tin was carried out galvanically in each case.

The measuring results are summarized in the following table. The average peak-to-valley height (mean peak-to-valley height Ra) was measured both in the rolling direction (L), as well as transversely to the rolling direction (Q).

| Sample | Testing direction | Peak-to-valley height | Layer thickness |
|---|---|---|---|
| 1 | L | 3.2 | 2.0 |
| | Q | 4.2 | |
| 2 | L | 5.0 | 2.5 |
| | Q | 5.4 | |
| 3 | L | 11.5 | 4.0 |
| | Q | 11.7 | |
| 4 | L | 7.0 | 2.0 |
| | Q | 7.5 | |

We claim:

1. A method for manufacturing tin-coated strips or sheets from copper or copper alloys, comprising the following steps:

rolling at least one side of a strip-shaped, semifinished copper product by means of a textured working roll to create a surface quality of an average peak-to-valley height within the range of 3 to 12 μm; and continuously coating the strip-shaped, semifinished copper product with tin or a tin-base alloy to create a tin layer;

wherein the method is conducted so as to create a tin-coated strip where the ratio of average peak-to-valley height to thickness of the tin layer is greater than 1.2.

2. The method for manufacturing tin-coated strips or sheets according to claim 1, wherein the method is conducted so as to create a tin-coated strip where the ratio of average peak-to-valley height to thickness of the tin layer is greater than 2.

3. The method for manufacturing tin-coated strips or sheets according to claim 1, wherein rolling is carried out by means of a textured working roll which has been textured by electron beam treatment.

4. The method for manufacturing tin-coated strips or sheets according to claim 1, wherein rolling is carried out by means of a textured working roll which has been textured by laser.

5. The method for manufacturing tin-coated strips or sheets according to claim 1, wherein the step of continuously coating the strip-shaped semifinished copper product is carried out galvanically.

6. The method for manufacturing tin-coated strips or sheets according to claim 5, wherein a tin layer of thickness between 1 and 8 μm is produced.

7. The method for manufacturing tin-coated strips or sheets according to claim 1, wherein the step of continuously coating the strip-shaped semifinished copper product is carried out using molten techniques.

8. The method for manufacturing tin-coated strips or sheets according to claims 6, wherein a tin layer of thickness between 1 and 8 μm is produced.

* * * * *